US009435118B2

(12) United States Patent
Al-Salloum et al.

(10) Patent No.: US 9,435,118 B2
(45) Date of Patent: Sep. 6, 2016

(54) INTERLOCKING MASONRY BLOCKS FOR CONSTRUCTION OF LOAD BEARING AND NON-LOAD BEARING WALLS

(71) Applicant: King Saud University, Riyadh (SA)

(72) Inventors: Yousef A. Al-Salloum, Riyadh (SA); Husain Abbas, Riyadh (SA); Tarek H Almusallam, Riyadh (SA)

(73) Assignee: King Saud University, Riyadh (SA)

( * ) Notice: Subject to any disclaimer, the term of this patent is extended or adjusted under 35 U.S.C. 154(b) by 4 days.

(21) Appl. No.: 14/554,273

(22) Filed: Nov. 26, 2014

(65) Prior Publication Data

US 2016/0145864 A1 May 26, 2016

(51) Int. Cl.

| | |
|---|---|
| ***E04B 2/18*** | (2006.01) |
| ***E04B 2/26*** | (2006.01) |
| ***E04B 2/44*** | (2006.01) |
| ***E04B 2/54*** | (2006.01) |
| *E04B 2/02* | (2006.01) |

(52) U.S. Cl.

CPC . *E04B 2/18* (2013.01); *E04B 2/26* (2013.01); *E04B 2/44* (2013.01); *E04B 2/54* (2013.01); *E04B 2002/0217* (2013.01); *E04B 2002/0232* (2013.01)

(58) Field of Classification Search

CPC ..... E04B 2/14; E04B 2002/023; E04B 2/18; E04B 2/26; E04B 2/44; E04B 2/54; E04B 2002/0206; E04B 2002/0208; E04B 2002/0215

USPC ..... 52/504, 505, 586.1, 586.2, 592.6, 52/220.2, 309.2, 379, 503, 591.1, 606, 52/604, 603, 600, 565

See application file for complete search history.

(56) References Cited

U.S. PATENT DOCUMENTS

| | | | | | |
|---|---|---|---|---|---|
| 820,387 | A * | 5/1906 | Burton | E04B 2/04 | 52/284 |
| 1,385,299 | A * | 7/1921 | Bilque | E04B 2/14 | 52/606 |
| 1,884,319 | A * | 10/1932 | Smith | E04B 2/42 | 52/236.5 |
| 2,042,992 | A * | 6/1936 | Hine | E04B 2/14 | 52/505 |
| 2,276,431 | A * | 3/1942 | Stewart | E04B 2/14 | 138/115 |
| 3,325,956 | A * | 6/1967 | Moraetes | E04B 2/18 | 52/606 |
| 3,410,044 | A * | 11/1968 | Moog | E04C 1/40 | 52/300 |
| 3,717,967 | A * | 2/1973 | Wood | E04B 2/54 | 52/259 |

(Continued)

*Primary Examiner* — Robert Canfield
*Assistant Examiner* — Matthew Gitlin
(74) *Attorney, Agent, or Firm* — Hauptman Ham, LLP

(57) ABSTRACT

An interlocking masonry block system for the construction of load bearing and non-load bearing walls includes a plurality of generally rectangular shaped building blocks wherein each block comprises a pair of opposite longitudinally extending sidewalls each of which includes an interior rectangular shaped vertical rib. The block also includes a central section disposed between the sidewalls in an abutting relationship therewith. Further, the central section defines one or two diagonally oriented rectangular vertical passageway extending through the central section at an angle of between about 30° and 45° and preferably at an angle of about 38°. The central section also includes one to three vertical extending recesses corresponding to and mating with the vertical ribs on each side thereof. The central section and the pair of sidewalls also define up to four rectangular shaped vertical passageways for utility pipes and/or electrical conduits.

10 Claims, 7 Drawing Sheets

(56) References Cited

U.S. PATENT DOCUMENTS 3,968,615 A * 7/1976 Ivany ..... E04B 2/8629 52/259
4,075,808 A * 2/1978 Pearlman ..... E04B 2/54 52/439
4,272,940 A * 6/1981 Nicolls ..... E04B 2/18 52/591.1
4,324,080 A * 4/1982 Mullins ..... B28B 11/042 52/309.12
4,557,094 A * 12/1985 Beliveau ..... E04B 2/18 52/405.4
4,856,249 A * 8/1989 Nickerson ..... E04C 1/41 52/309.13
5,802,797 A * 9/1998 Storer-Folt ..... E04B 2/44 52/592.5
5,992,102 A * 11/1999 Ozawa ..... E04B 2/44 52/100
6,122,881 A * 9/2000 Aubertot ..... E04B 2/14 52/596
6,164,035 A * 12/2000 Roberts ..... E04B 1/14 52/220.2
6,205,726 B1 * 3/2001 Hoadley ..... E04B 2/16 52/309.12
6,223,493 B1 * 5/2001 Ruggeri ..... E04B 2/16 52/592.6
6,550,208 B2 * 4/2003 Nanayakkara ..... E04B 2/14 52/223.7
6,591,569 B2 * 7/2003 Azar ..... E04B 2/16 52/604
6,883,281 B1 * 4/2005 Chavez-Gandara .... E02D 31/02 52/223.7
6,962,028 B2 * 11/2005 Banova ..... E04B 2/44 52/379
7,665,269 B2 * 2/2010 Azar ..... E04B 2/16 52/592.1
8,099,918 B2 * 1/2012 Marsh ..... E02D 27/02 52/253
8,201,379 B2 * 6/2012 Bucheger ..... E04B 2/44 52/223.7
8,596,014 B2 * 12/2013 Genest ..... E04C 1/00 52/600
8,640,407 B2 2/2014 Alsayed et al.
2002/0152710 A1 * 10/2002 Guibert ..... E04B 2/16 52/604
2006/0101756 A1 * 5/2006 McClure ..... E04C 1/41 52/405.1
2006/0150559 A1 * 7/2006 Haener ..... E04B 2/44 52/606
2006/0156673 A1 * 7/2006 Nakamura ..... E04B 2/14 52/596
2009/0288361 A1 * 11/2009 Badin ..... B28B 1/08 52/589.1
2013/0333313 A1 * 12/2013 Alsayed ..... E04B 2/54 52/220.1
2014/0150361 A1 * 6/2014 Castonguay ..... E04B 2/26 52/309.4

* cited by examiner

INTERLOCKING MASONRY BLOCKS FOR CONSTRUCTION OF LOAD BEARING AND NON-LOAD BEARING WALLS

FIELD OF THE INVENTION

This invention relates to interlocking masonry building blocks and construction of load bearing and non-load bearing walls and more particularly to interlocking masonry walls that include a pair of vertically extending rebars and horizontal tie bar wrapped around each of the parallel rebars in opposite directions.

BACKGROUND OF THE INVENTION

A variety of interlocking type masonry building blocks are available for the construction of load bearing and non-load bearing walls. Such blocks are laid in courses without the use of mortar as done in conventional masonry. As a general rule, conventional masonry wall blocks are heavy and relatively difficult to handle. Such blocks typically include projections that mate with corresponding indentations on adjacent blocks. However, many of these projections are relatively small and thus there is an inherent weakness in the block. Also the use of small projections and small indentations means that the blocks have to be built to close tolerances which make the blocks more expensive. The typical small projections may be easily broken or chipped off prior to or during construction which means that many blocks are discarded adding to the expense. Further, the available blocks do not have suitable provisions for the installation of embedded utilities. Thus there is a need for masonry wall blocks that are relatively light and easier to handle that are cost effective to manufacture and easily assembled into a more stable and dependable wall structure with provisions for embedding utilities.

A U.S. Pat. No. 8,640,407 of Saleh H. Alsayed, Mohammed S. Alhaddad and two inventors of the present invention disclose a rectangular shaped interlocking building block comprising a pair of exterior sides and an upper and a lower longitudinally extending horizontal faces and a pair of opposite vertical ends and wherein the building blocks include a pair of side members and wherein each of the side members includes a vertically extending exterior rib on an inner side thereof; a generally rectangular intermediate section is disposed between the side members in an abutting relationship and wherein the intermediate section defines a rectangular shaped vertical recess between the side members and a recess that extends between a bottom of one of the side members and the top of an adjacent block. The rectangular rib and vertical recesses are constructed and dimensioned so that one rib fits loosely but closely within the recess and the intermediate section includes a pair of elliptical shaped vertical passageways.

Notwithstanding the above, it is presently believed that there is a need and a potential commercial market for the improved building blocks and wall structure according to the present invention. There should be a need and a potential market for such masonry building blocks because they are strong, will support heavy vertical loads and at the same time are relatively lightweight. In addition, the masonry building blocks in accordance with the present invention have a high resistance to wind and other lateral forces and can be manufactured and sold at a competitive price. Still further the weight and costs of such blocks are further reduced by the rectangular vertical passageways that extend through the blocks.

BRIEF SUMMARY OF THE INVENTION

In essence, the present invention contemplates an interlocking masonry block system for the construction of load bearing and non-load bearing walls. The block system comprises or consists of a plurality of generally rectangular shaped building blocks wherein each block comprises or consists of a pair of opposite longitudinally extending sidewalls each of which includes an internal rectangular shaped vertical rib. The block also includes a central section disposed between the sidewalls in an abutting relationship therewith. In addition, the central section defines one or two diagonally oriented rectangular vertical passageways extending through the central section at an angle of between 30° and 45° and preferably an angle of about 38°. The central section also includes vertical extending recesses corresponding to and mating with the vertical ribs on each side thereof. Still further, the central section and the pair of sidewalls define four rectangular shaped vertical passageways for conduit and/or utility pipes.

In a preferred embodiment of the invention a pair of vertically extending rebars are extending through several layers of blocks are disposed in the angularly disposed rectangular vertical passageways with one of the rebars at each end of the rectangular passageway. A horizontal tie bar is wrapped around each of the rebars in opposite directions.

In a further embodiment of the invention the masonry blocks as disclosed herein are arranged in multiple rows to provide load bearing or non-load bearing walls with and without vertical rebars and horizontal tie rods as well as horizontal rebars. When rebars are provided, the openings are grouted and when no rebars are provided, the blocks may be used with or without grouting.

The invention will now be described in connection with the accompanying drawings wherein like parts are identified with like numbers.

DETAILED DESCRIPTION OF THE PREFERRED EMBODIMENTS OF THE INVENTION

Figure 1:
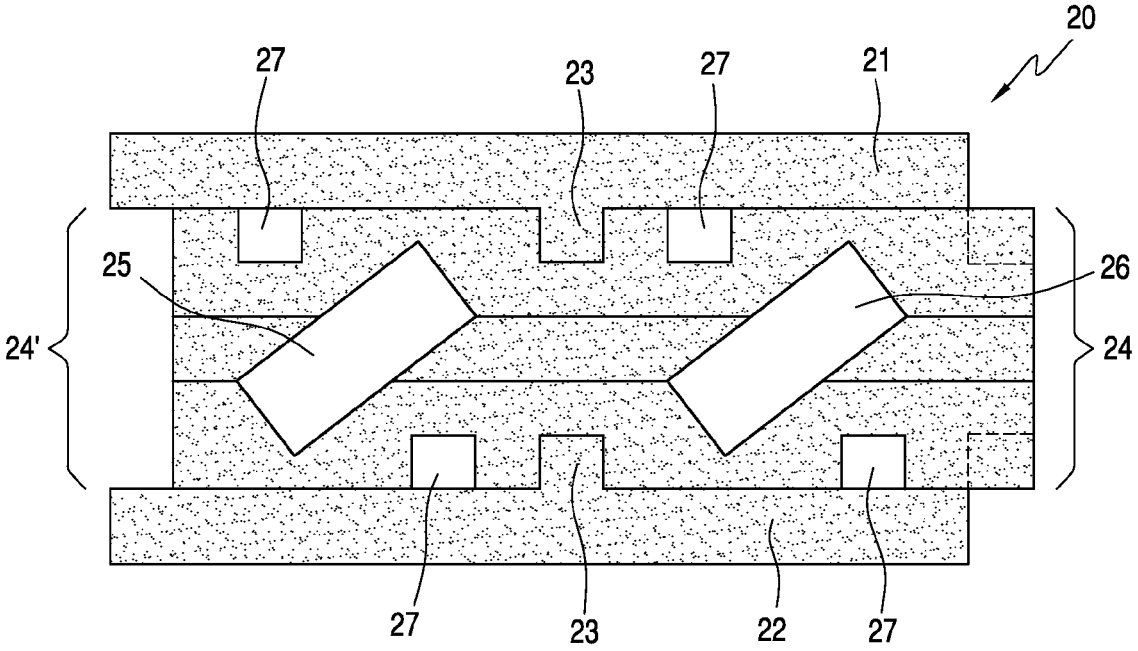
FIG. 1 is a plan view of a masonry block in accordance with a first embodiment of the invention.
Figure 2:
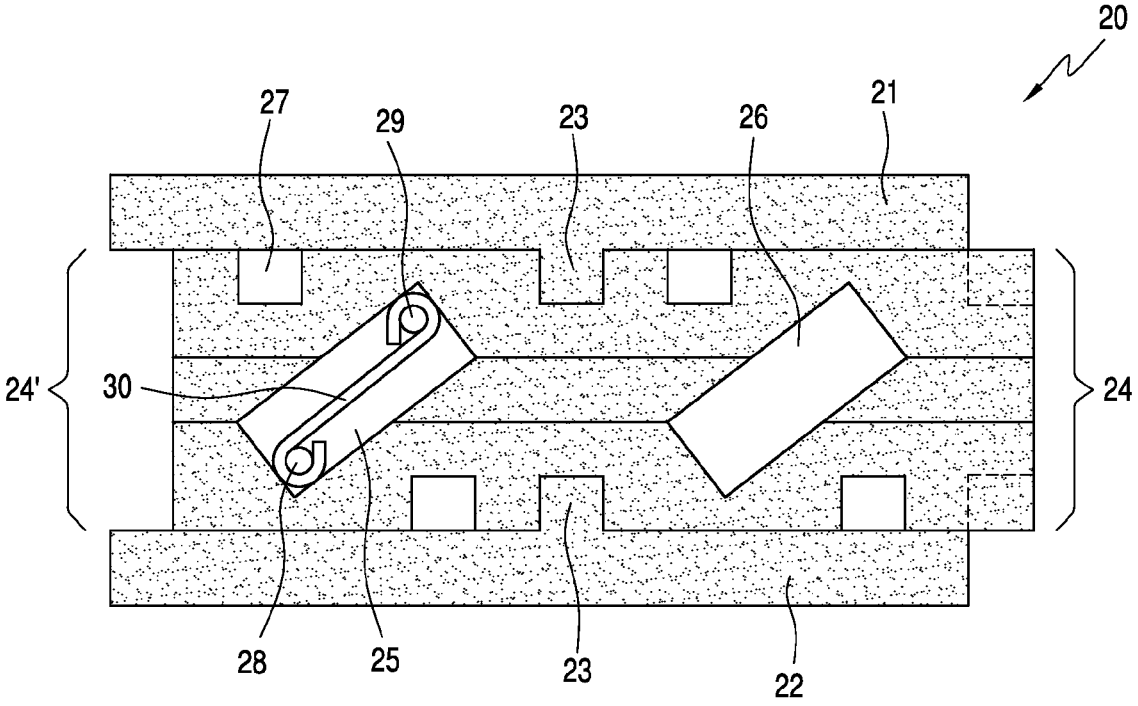
FIG. 2 is a plan view of a masonry block in accordance with a second embodiment of the invention.

As illustrated in FIGS. 1 and 2, an interlocking masonry block 20 comprises and/or consists of a pair of sidewalls 21 and 22 having a length of about 400 mm, a height of about 200 mm and a thickness of about 35 mm. Each side member also includes an inwardly extending rib 23 having a width of about 30 mm and a thickness of about 25 mm. In other words, the ribs extend inwardly into a central section 24.

The central section 24 includes one or two vertical rectangular shaped passageways 25 and 26 extending through the block 20. Each of the passageways 25 and 26 define a rectangular shape of about 105 mm in length and about 44 mm in width. The passages are disposed diagonally within the central section 24 at an angle of preferably about 38° or within a range of 30° to 45° with respect to a longitudinal axis of the central section 24.

The central section 24 is designed to extend outwardly beyond the sidewalls 21 and 22 at one end of the block 20 by about 30 mm and includes a recess at the opposite end of about 30 mm. The outward extension is designed to fit slightly snugly within a comparable recess in an adjacent block. For example, there might be about a 2 mm difference in the size of the outward extension and the recess in an adjacent block.

The central section 24 together with the sidewalls 21 and 22 form two large size and four small size vertical passageways extending from the top of the block 20 through the block 20. These passages are aligned with adjacent blocks above and below the block 20 in a column of aligned blocks assembled in a wall of multiple rows so that conduits or pipes can extend from a top of the wall to an intermediate or bottom portion thereof.

In the preferred embodiment of the invention a first vertical rebar 28 extends downwardly through a column of aligned blocks in a wall at one end of the rectangular passageways 25 and 26. A second vertically disposed rebar 29 is disposed at an opposite end of the rectangular passages extending through the column of blocks in a wall. An important feature in the preferred embodiment resides in a generally horizontal tie bar 30 that is wrapped tightly around the first rebar 28 as for example in a clockwise direction while the opposite end is wrapped tightly around the second vertical rib 29 in the opposite or counterclockwise direction.

Figure 3A:
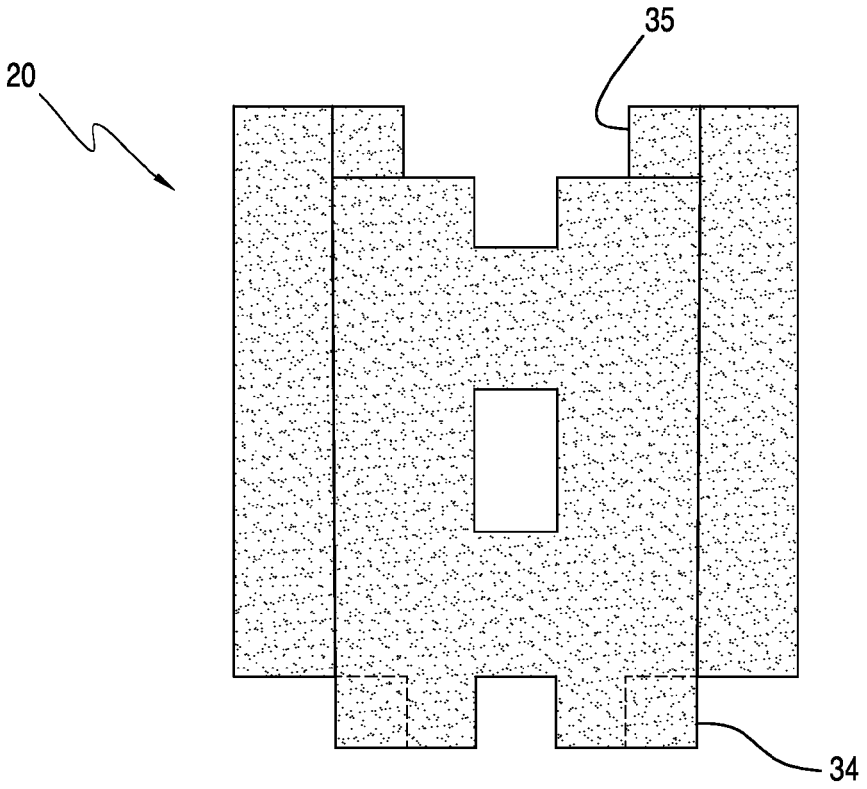
FIG. 3*a* is an end view of a masonry block in accordance with the invention.
Figure 3B:
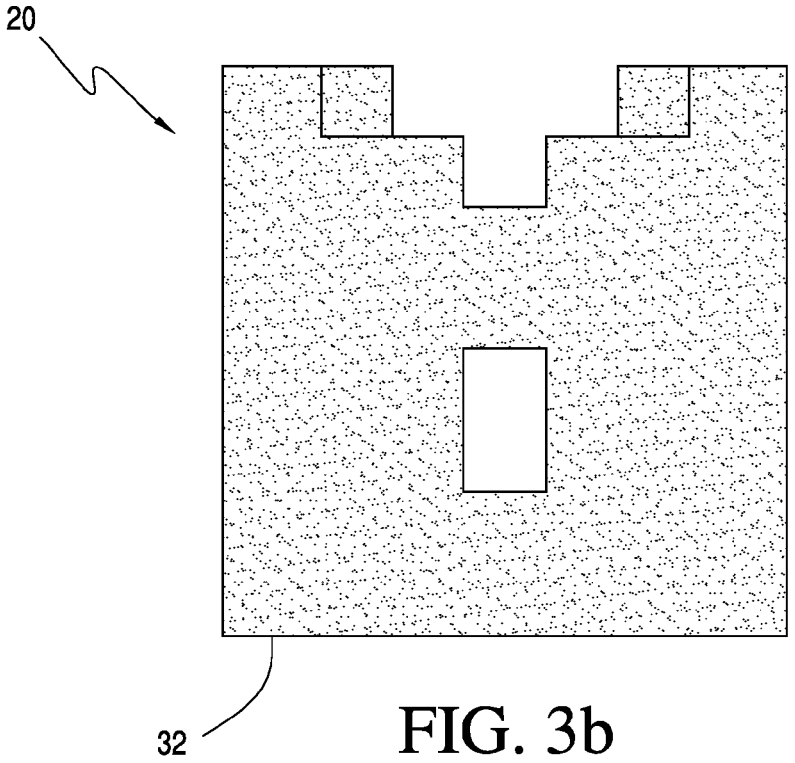
FIG. 3*b* is an end view of a masonry block as used in a first course of a wall in accordance with the invention.

FIGS. 3*a* and 3*b* illustrate end views of a masonry building block 20 of a general configuration for an upper portion of a wall and a modification for a first or bottom row of blocks wherein the block 20 in a wall has a flat planar bottom surface 32 for resting on a flat concrete foundation. As shown in FIG. 3*a* the upper row of blocks have a downward projection 34 that matches and/or fits slightly snugly within a recess 35 to provide an interlocking assembly that can be fitted and maintained together.

Figure 4:
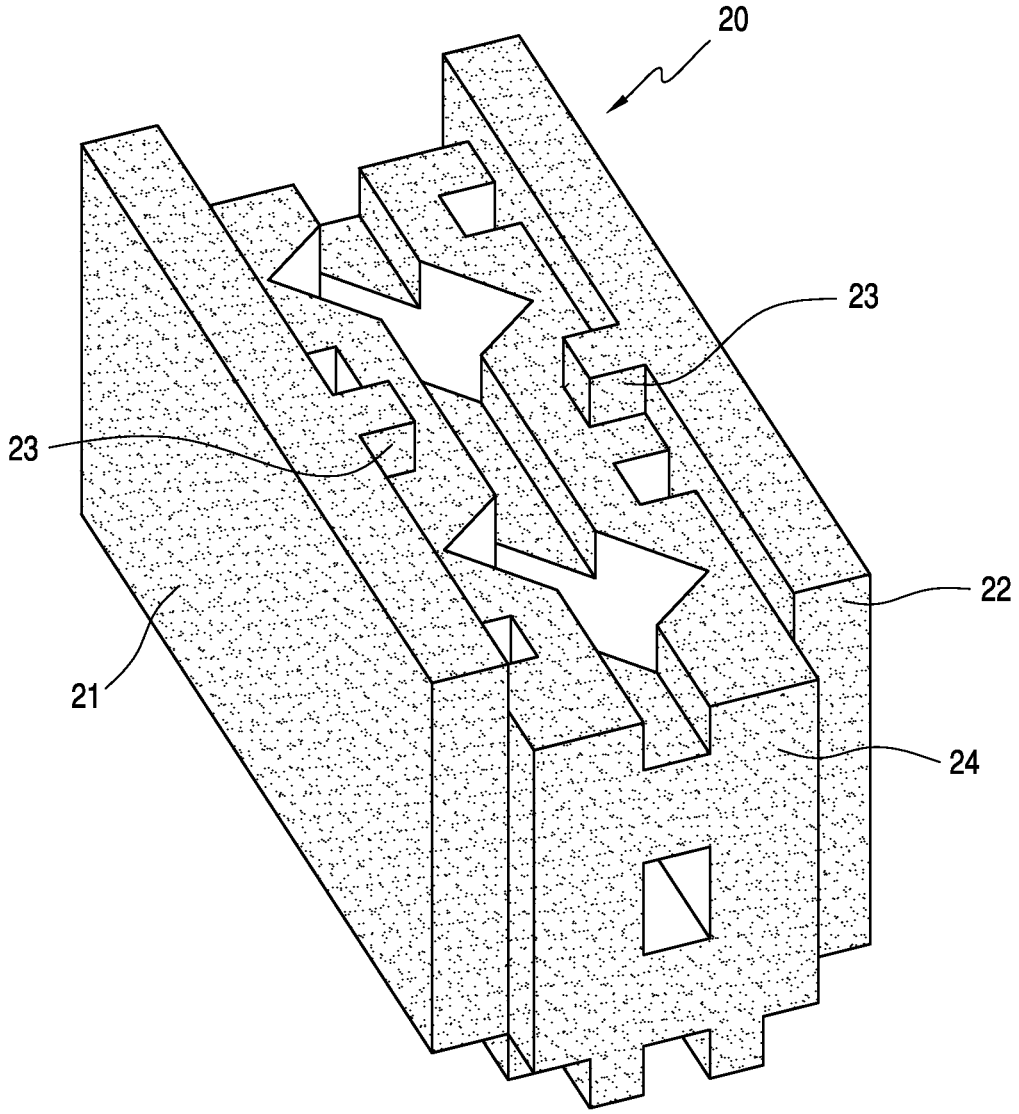
FIG. 4 is an isometric view of a masonry block in accordance with a first embodiment of the invention.
Figure 5:
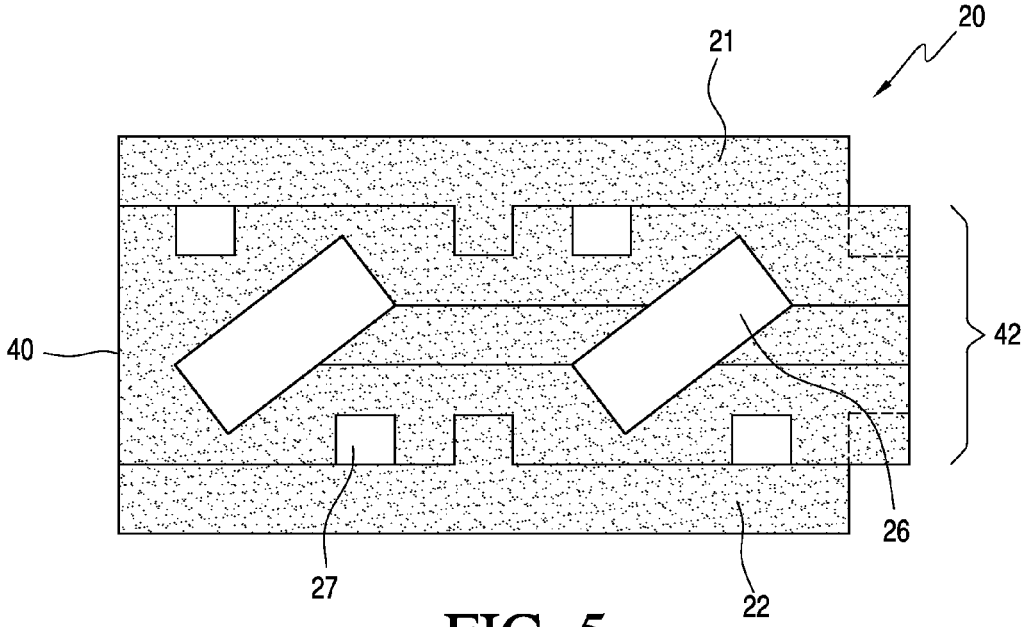
FIG. 5 is a plan view of a masonry block for closing a left end of a wall in accordance with the present invention.
Figure 6:
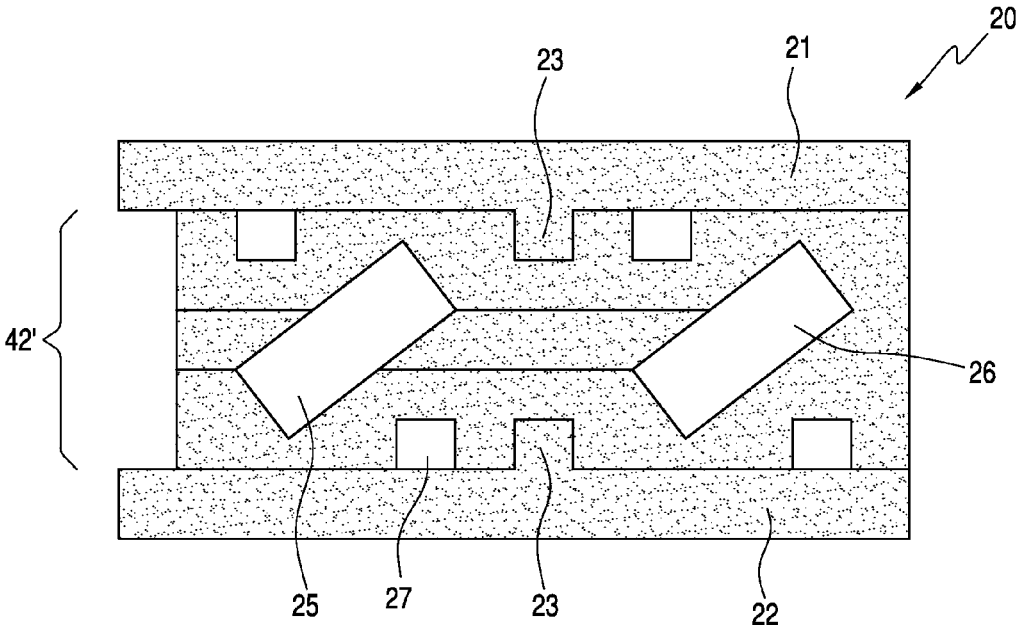
FIG. 6 is a plan view of a masonry block for closing a right end of a wall in accordance with the present invention.
Figure 11:
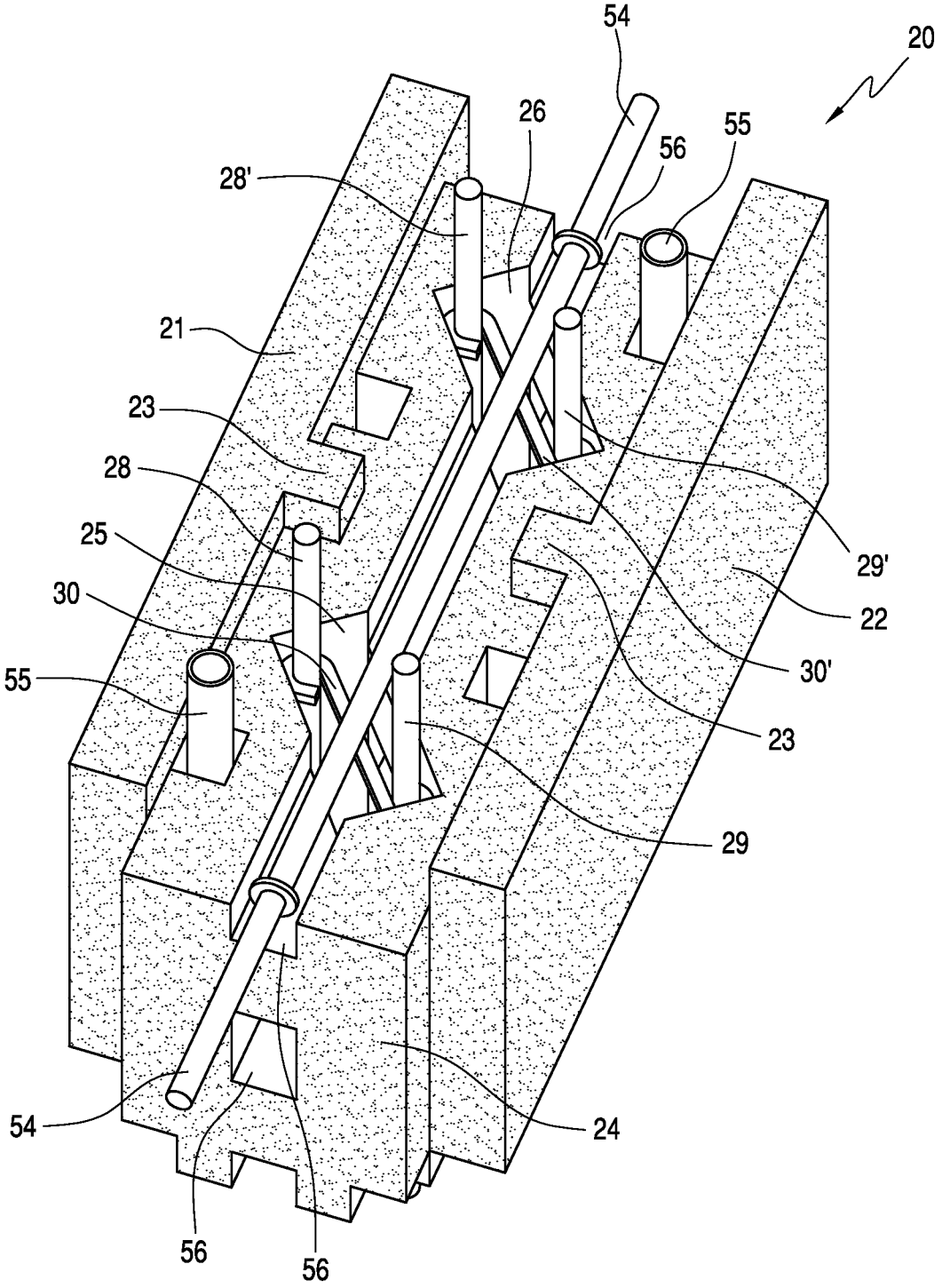
FIG. 11 is an isometric illustration of a masonry block in accordance with the second embodiment of the invention together with rebars, tie bars and utility pipes.

An isomeric building block 20, as shown in FIG. 4, is a one-piece block as described with respect to FIGS. 1 and 3*a* without the vertical rebars 28 and 29 and tie rods 30, as shown in FIG. 11. It is contemplated that the block 20 may be manufactured in various forms as illustrated in FIGS. 5 and 6. For example, the block 20 includes a left end closing block wherein the left end of the block has a smooth or planar surface 40 while the opposite end 42 of the control section projects outwardly beyond the sidewalls 21 and 22.

The central section 24 also includes a recess 42' while the sidewalls 21 and 22 extend beyond the central section. As illustrated in FIG. 5 and FIG. 6 the central section defines a pair of vertically and diagonally disposed rectangular passageways 25 and 26 that form an angle with respect to a longitudinal axis of the block between about 30° to 45° and preferably about 38°. Still further, the central section defines four rectangular passageways 27 with two on each side of the central section. The vertical passageways 27 have a fourth side closed by the sidewalls 21 and/or 22, respectively.

Figure 7:
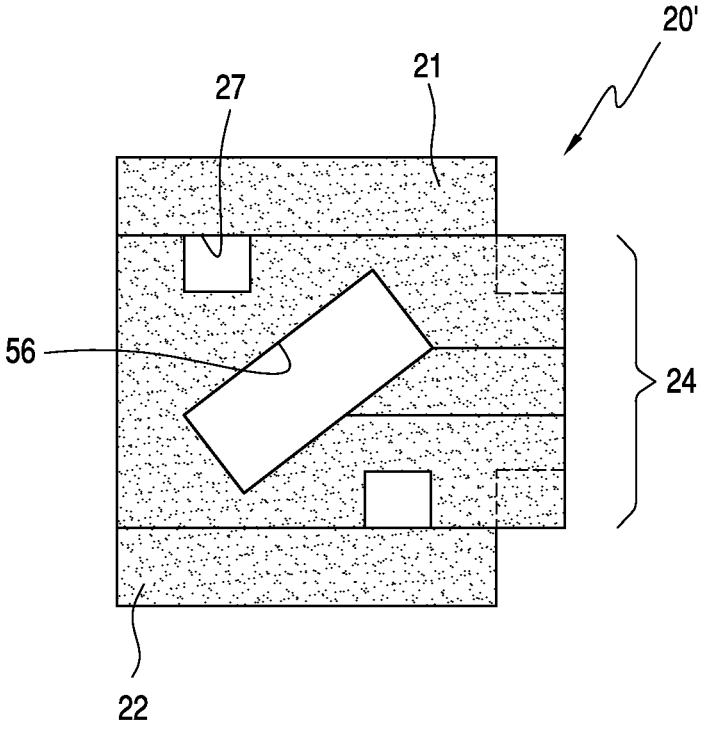
FIG. 7 is a plan view of a half block for closing the left end of a wall in accordance with the present invention.
Figure 8:
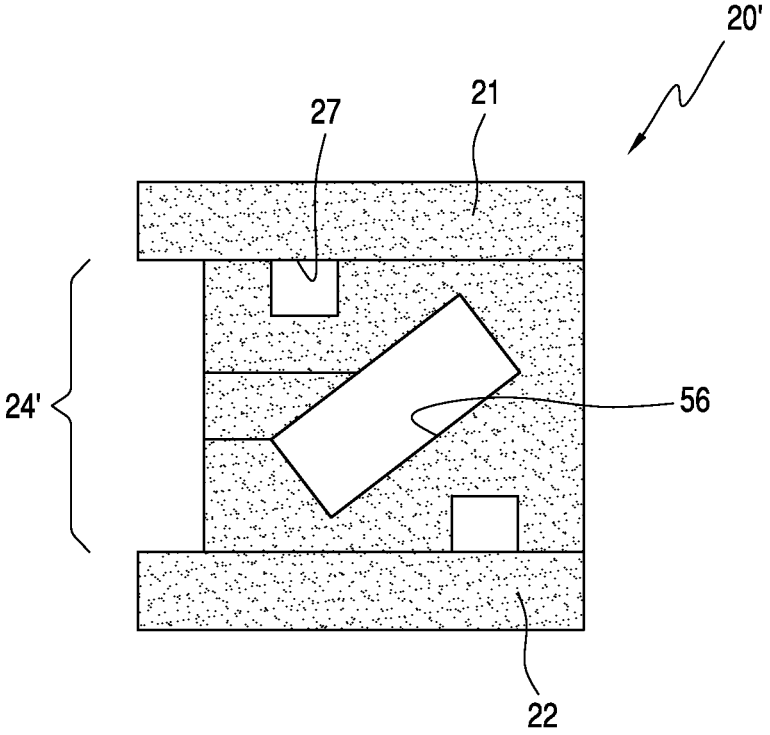
FIG. 8 is a plan view of a half block for closing the right end of a wall in accordance with the invention.

A still further modification of the block 20 is illustrated in FIGS. 7 and 8. For example, FIG. 7 shows a so-called half block i.e., a masonry building block that is about one-half the length of a full size block and has a single diagonally disposed rectangular passageway 56 extending through the central section 24 of the block 20. The central section has only two vertical passageways 27 with a passageway disposed with one passageway on each side of the central section. Such blocks are used to place between blocks in a row so that the block in one row overlaps the block in a lower or upper row to increase the strength of a wall or resistance to displacement.

Figure 9:
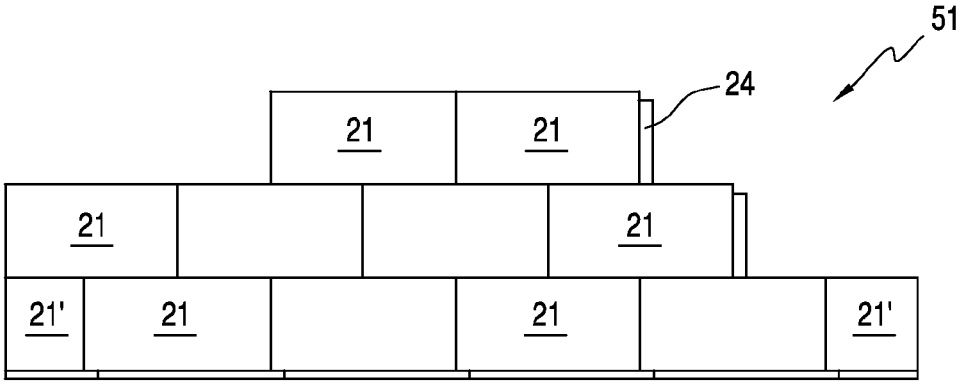
FIG. 9 is a side elevational view of a partially completed wall in accordance with the invention.
Figure 10:
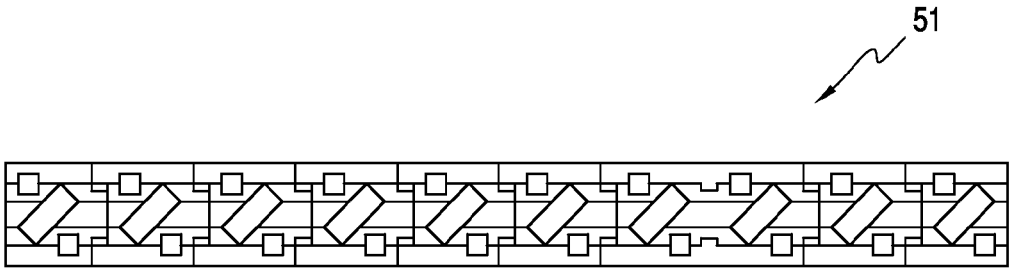
FIG. 10 is a plan view of a masonry block wall in accordance with the invention.

As shown in FIG. 7, the block 20' has a smooth planar end or edge on the left side while the block 20' in FIG. 8 has a smooth planar surface on the other side for placement at the end of the other end of the row. A wall 51 is illustrated in FIGS. 9 and 10 wherein a first or lower row is formed on a flat foundation with a full rectangular block 20 and half or end blocks 21'. The next horizontal row is shown with regular blocks 21 overlapping the intersections of adjacent blocks 21 in the lower row. As illustrated a third or top row of blocks 21 or partial row consists of two regular sized blocks i.e., without any half blocks.

For contrast, FIG. 10 illustrates a top or bottom row of a wall with two end blocks with smooth or flat outer surfaces.

A building block 20 with four vertical rebars 28, 28', 29 and 29' are illustrated in FIG. 11. The four rebars 28, 28', 29 and 29' are disposed in the two vertical rectangular shaped passageways 25 and 26. Each of the pair of rebars 28, 29 and 28', 29' are tied together by tie bars 30 and 30', respectively. The central section 24 of the building block 20 together with the sidewalls or side members 21 and 22 also define four vertical passageways each of which have a cross sectional rectangular shape of about 25 by 30 mm. These vertical rectangular passageways accommodate utility pipes 55 (only two of which are shown) or electrical conduits.

In addition, one or more steel bars 54 (only one shown) have been passed through one or more horizontal passageways 56 that pass through the building blocks 20 and through several columns of building blocks 20. The horizontal steel bar or bars are positioned within the building blocks by one or more spacers.

It should be recognized that the tie bars 30 are not necessarily included in each block but may be placed in alternate blocks or in a column of perhaps a few in a relatively high wall.

It should also be recognized that the central section includes two vertical passageways to accommodate ribs 23 on each of the central section 24.

While the invention has been described in connection with its preferred embodiment, it should be recognized that changes and modifications may be made therein without departing from the scope of the appended claims.

What is claimed is:

1. A rectangular shaped masonry building block comprising:

a central section including a bottom surface, a top surface, a pair of oppositely disposed longitudinally extending side surfaces, two ends and, a pair of oppositely disposed longitudinally extending sidewalls each of which includes a bottom surface and a rectangular shaped vertical rib; and wherein said central section is disposed between said sidewalls in an abutting relation therewith and wherein said central section defines a pair of diagonally oriented rectangular vertical passageways extending through said central section at an angle of between 30° and 45° and including a vertically extending rectangular recess corresponding to and mating with said vertical rib in each of said sidewalls; and said central section and said pair of sidewalls defining four rectangular passageways for conduits and utility pipes; and in which said central section is recessed below the top of said sidewalls by about a same distance as the central section extends below the bottom of said sidewalls.

2. The rectangular shaped masonry building block according to claim 1, in which said diagonally oriented rectangular vertical passageways extends through said central section at an angle of about 38°.

3. The rectangular shaped masonry building block according to claim 1, which includes a pair of vertically disposed rebars extending through said diagonally oriented rectangular passages at opposite ends thereof and a generally horizontal tie bar fixing said vertical rebars in a spaced relation to one another with opposite ends of said tie bars wrapped around said rebar in opposite directions.

4. A masonry wall consisting of a generally vertical array made up of a plurality of aligned rows and columns of the blocks as defined in claim 3.

5. The masonry wall as defined in claim 4 which also comprises a horizontal steel rod extending through a horizontal passageway in said column of blocks.

6. A rectangular shaped masonry building block comprising a pair of opposite longitudinally extending sidewalls each of which includes a rectangular shaped vertical rib, a central section disposed between said sidewalls in an abutting relationship therewith and wherein said central section defines a diagonally oriented rectangular vertical passageway extending through said central section at an angle of between 30° and 45° and including a vertically extending rectangular recess in each side thereof corresponding to and mating with said vertical ribs in each of said sidewalls and said central section and said sidewalls defining two rectangular passages for conduits and utility pipes.

7. The rectangular shaped masonry building block according to claim 6, which includes a pair of vertically disposed rebars extending through said diagonally oriented rectangular passageway at opposite ends thereof and a generally horizontal tie bar fixing said vertical rebars in a space relationship to one another with opposite ends of said tie bars wrapped around said vertical rebars in opposite directions.

8. The rectangular shaped masonry building block according to claim 7, in which one vertical end horizontal planar edge of said block defines a smooth surface and wherein said central section extends beyond said sidewall at an opposite end of said block for use at one end of a wall.

9. The rectangular shaped masonry building block according to claim 8, in which said bottom surface of said block is flat for use in a first row of blocks in a wall.

10. A rectangular shaped masonry building block consisting of a pair of opposite longitudinally extending sidewalls each of which includes a rectangular shaped vertical rib, and a central section disposed between said sidewalls in an abutting relation therewith and wherein said central section defines a pair of diagonally oriented rectangular vertical passageways extending through said central section at an angle of between 30° and 45° and including a vertically extending rectangular recess corresponding to and mating with said vertical ribs in said sidewalls and said central section and said pair of sidewalls defining four rectangular passages for conduits and utility pipes.

* * * * *